US010508503B2

(12) United States Patent
Bilen

(10) Patent No.: US 10,508,503 B2
(45) Date of Patent: Dec. 17, 2019

(54) CUTTING ELEMENTS, EARTH-BORING TOOLS INCLUDING THE CUTTING ELEMENTS, AND METHODS OF FORMING THE EARTH-BORING TOOLS

(71) Applicant: Baker Hughes, a GE company, LLC, Houston, TX (US)

(72) Inventor: Juan Miguel Bilen, The Woodlands, TX (US)

(73) Assignee: Baker Hughes, a GE company, LLC, Houston, TX (US)

( * ) Notice: Subject to any disclaimer, the term of this patent is extended or adjusted under 35 U.S.C. 154(b) by 129 days.

(21) Appl. No.: 15/274,254

(22) Filed: Sep. 23, 2016

(65) Prior Publication Data

US 2018/0087325 A1 Mar. 29, 2018

(51) Int. Cl.
*E21B 10/56* (2006.01)
*E21B 10/567* (2006.01)

(52) U.S. Cl.
CPC ..... *E21B 10/5673* (2013.01)

(58) Field of Classification Search
CPC ..... E21B 10/5673; E21B 10/08; E21B 10/42; E21B 10/5735
See application file for complete search history.

(56) References Cited

U.S. PATENT DOCUMENTS 5,333,699 A 8/1994 Thigpen et al.
5,383,527 A 1/1995 Azar
5,421,423 A * 6/1995 Huffstutler ..... E21B 10/16 175/374
6,290,008 B1 9/2001 Portwood et al.
7,363,992 B2 4/2008 Stowe et al.
7,677,333 B2 3/2010 Mensa-Wilmot
7,841,259 B2 11/2010 Smith et al.
8,096,372 B2 1/2012 Shen et al.
8,132,633 B2 3/2012 De Maindreville et al.
8,307,739 B2 11/2012 Stevens et al.
8,731,717 B2 5/2014 Luce et al.
8,807,247 B2 8/2014 Scott et al.
8,851,207 B2 10/2014 Gavia et al.
9,259,803 B2 2/2016 DiGiovanni
9,309,724 B2 4/2016 Scott et al.
2003/0116361 A1 6/2003 Smith et al.
2006/0032677 A1 2/2006 Azar et al.
2007/0235230 A1 10/2007 Cuillier et al.
(Continued)

FOREIGN PATENT DOCUMENTS

EP 0154936 B1 5/1990
WO 9214906 A1 9/1992
WO 2009006510 A3 1/2009

OTHER PUBLICATIONS

International Search Report for International Application No. PCT/US2017/053035 dated Dec. 15, 2017, 4 pages.
(Continued)

*Primary Examiner* — Brad Harcourt
(74) *Attorney, Agent, or Firm* — TraskBritt

(57) ABSTRACT

A cutting element comprises a supporting substrate exhibiting a three-dimensional, laterally elongate shape, and a cutting table of a polycrystalline hard material attached to the supporting substrate and comprising a non-planar cutting face. An earth-boring tool and method of forming an earth-boring tool are also described.

18 Claims, 6 Drawing Sheets

(56) References Cited

U.S. PATENT DOCUMENTS

| | | | | |
|---|---|---|---|---|
| 2007/0240905 | A1 | 10/2007 | Mensa-Wilmot | |
| 2008/0035387 | A1 | 2/2008 | Hall et al. | |
| 2008/0223622 | A1 | 9/2008 | Duggan et al. | |
| 2008/0264696 | A1 | 10/2008 | Dourfaye et al. | |
| 2009/0008155 | A1 | 1/2009 | Sherwood, Jr. | |
| 2010/0243334 | A1 | 9/2010 | Dourfaye et al. | |
| 2011/0031035 | A1 | 2/2011 | Stowe, II et al. | |
| 2011/0155472 | A1 | 6/2011 | Lyons et al. | |
| 2013/0015000 | A1* | 1/2013 | Zhang | E21B 10/56 175/428 |
| 2013/0112485 | A1* | 5/2013 | Richert | E21B 10/46 175/332 |
| 2013/0220706 | A1* | 8/2013 | Azar | E21B 10/26 175/431 |
| 2014/0048340 | A1 | 2/2014 | DiGiovanni et al. | |
| 2014/0196959 | A1* | 7/2014 | Hall | E21B 10/5735 175/432 |
| 2014/0262543 | A1 | 9/2014 | Stone et al. | |
| 2015/0259988 | A1 | 9/2015 | Chen et al. | |
| 2016/0017668 | A1 | 1/2016 | Meier et al. | |
| 2016/0376847 | A1* | 12/2016 | Matthews | E21B 10/5673 175/430 |

OTHER PUBLICATIONS

International Written Opinion for International Application No. PCT/US2017/053035 dated Dec. 15, 2017, 10 pages.

* cited by examiner

CUTTING ELEMENTS, EARTH-BORING TOOLS INCLUDING THE CUTTING ELEMENTS, AND METHODS OF FORMING THE EARTH-BORING TOOLS

TECHNICAL FIELD

Embodiments of the disclosure relate to cutting elements, to earth-boring tools including the cutting elements, and to methods of forming the earth-boring tools.

BACKGROUND

Earth-boring tools for forming wellbores in subterranean formations may include cutting elements secured to a body. For example, a fixed-cutter earth-boring rotary drill bit ("drag bit") may include cutting elements fixedly attached to a bit body thereof. As another example, a roller cone earth-boring rotary drill bit may include cutting elements secured to cones mounted on bearing pins extending from legs of a bit body. Other examples of earth-boring tools utilizing cutting elements include, but are not limited to, core bits, bi-center bits, eccentric bits, hybrid bits (e.g., rolling components in combination with fixed cutting elements), reamers, and casing milling tools.

A cutting element used in an earth-boring tool often includes a supporting substrate and a cutting table. The cutting table may comprise a volume of superabrasive material, such as a volume of polycrystalline diamond ("PCD") material, on or over the supporting substrate. One or more surfaces of the cutting table act as a cutting face of the cutting element. During a drilling operation, one or more portions of the cutting face are pressed into a subterranean formation. As the earth-boring tool moves (e.g., rotates) relative to the subterranean formation, the cutting table drags across surfaces of the subterranean formation and the cutting face removes (e.g., shears, cuts, gouges, crushes, etc.) a portion of formation material.

It is often necessary for the cutting table of one or more cutting elements attached to a body of an earth-boring tool to be oriented and/or aligned in a particular manner to facilitate desired interaction between the cutting table and surfaces of the subterranean formation during use and operation of an earth-boring tool as well as, in some instances, desired interaction between the cutting element and another cutting element at the same or adjacent radial location from a centerline of the earth-boring tool. The cutting table may, for example, exhibit a non-planar, asymmetric cutting face that requires a particular orientation relative to a rotational path traveled by the cutting element in order to effectively engage the subterranean formation. Unfortunately, conventional methods of orienting and/or aligning features (e.g., a non-planar, asymmetric cutting face) of a cutting table can be inconsistent, and/or can require the use of additional features (e.g., alignment features, such as bumps, holes, grooves, etc.), marks, and/or tools that can be difficult to effectively form and/or employ. In addition, even if the features of the cutting table are initially provided with desired orientations and/or alignments, the geometric configurations of conventional cutting elements are often insufficient to avoid disorientation and/or misalignment of the features of the cutting table during use and operation of the earth-boring tool.

Accordingly, it would be desirable to have cutting elements, earth-boring tools (e.g., rotary drill bits), and methods of forming and using the cutting elements and the earth-boring tools facilitating enhanced cutting efficiency and prolonged operational life during drilling operations as compared to conventional cutting elements, conventional earth-boring tools, and conventional methods of forming and using the conventional cutting elements and the conventional earth-boring tools.

BRIEF SUMMARY

Embodiments described herein include cutting elements, earth-boring tools including the cutting elements, and methods of forming the earth-boring tools. For example, in accordance with one embodiment described herein, a cutting element comprises a supporting substrate exhibiting a three-dimensional, laterally elongate shape, and a cutting table of a polycrystalline hard material attached to the supporting substrate and comprising a non-planar cutting face.

In additional embodiments, an earth-boring tool comprises a structure having a pocket therein facing outwardly from a surface of the structure and exhibiting a three-dimensional, laterally elongate shape, and a cutting element secured within the pocket in the structure. The cutting element comprises a supporting substrate exhibiting a three-dimensional, laterally elongate shape complementary to the shape of the pocket in the structure, and a cutting table attached to the supporting substrate at an interface and comprising a non-planar cutting face.

In yet additional embodiments, a method of forming an earth-boring tool comprises forming a pocket exhibiting a non-circular lateral cross-sectional shape in an outwardly facing surface of a structure of an earth-boring tool. A cutting element is secured within the pocket in the structure. The cutting element comprises a supporting substrate, and a cutting table secured to the supporting substrate. The supporting substrate has a non-circular lateral cross-sectional shape complementary to the non-circular lateral cross-sectional shape of the pocket.

DETAILED DESCRIPTION

Figure 1:
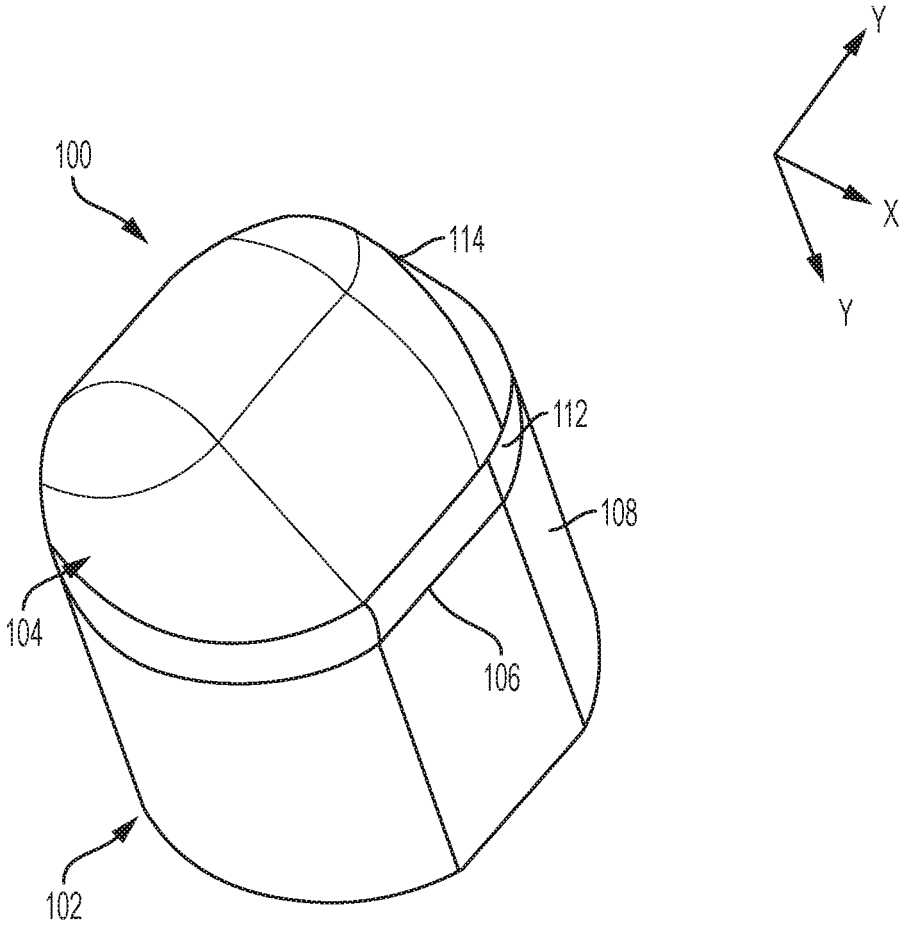
FIG. 1 is a perspective view of a cutting element, in accordance with an embodiment of the disclosure.

Cutting elements for use in earth-boring tools are described, as are earth-boring tools including the cutting elements, and methods of forming and using the cutting elements and the earth-boring tools. In some embodiments, a cutting element includes a supporting substrate, and a cutting table attached to the supporting substrate at an interface. The supporting substrate has a three-dimensional (3D), laterally elongate geometry including a non-circular lateral cross-sectional shape. The cutting table may exhibit a non-planar cutting face, such as an asymmetrical non-planar cutting face. The cutting element may be secured within a pocket in a structure (e.g., blade) of an earth-boring tool. The pocket may be formed to exhibit a 3D, laterally elongate geometry including a non-circular lateral cross-sectional shape complementary to the non-circular lateral cross-sectional shape of the cutting element. The geometric configuration of the supporting substrate relative to the geometric configuration of the pocket may facilitate desirable orientation and alignment of the cutting table of the cutting element without the need for additional features (e.g., alignment features, such as bumps, holes, grooves, etc.), marks, and/or tools. The complementary geometric configurations of the supporting substrate and the pocket may also prevent undesirable changes to the orientation and alignment of the cutting table during use and operation of the earth-boring tool. The configurations of the cutting elements and earth-boring tools described herein may provide enhanced drilling efficiency and improved operational life as compared to the configurations of conventional cutting elements and conventional earth-boring tools.

The following description provides specific details, such as specific shapes, specific sizes, specific material compositions, and specific processing conditions, in order to provide a thorough description of embodiments of the present disclosure. However, a person of ordinary skill in the art will understand that the embodiments of the disclosure may be practiced without necessarily employing these specific details. Embodiments of the disclosure may be practiced in conjunction with conventional fabrication techniques employed in the industry. In addition, the description provided below does not form a complete process flow for manufacturing a cutting element or an earth-boring tool. Only those process acts and structures necessary to understand the embodiments of the disclosure are described in detail below. Additional acts to form a complete cutting element or a complete earth-boring tool from the structures described herein may be performed by conventional fabrication processes.

Drawings presented herein are for illustrative purposes only, and are not meant to be actual views of any particular material, component, structure, device, or system. Variations from the shapes depicted in the drawings as a result, for example, of manufacturing techniques and/or tolerances, are to be expected. Thus, embodiments described herein are not to be construed as being limited to the particular shapes or regions as illustrated, but include deviations in shapes that result, for example, from manufacturing. For example, a region illustrated or described as box-shaped may have rough and/or nonlinear features, and a region illustrated or described as round may include some rough and/or linear features. Moreover, sharp angles that are illustrated may be rounded, and vice versa. Thus, the regions illustrated in the figures are schematic in nature, and their shapes are not intended to illustrate the precise shape of a region and do not limit the scope of the present claims. The drawings are not necessarily to scale. Additionally, elements common between figures may retain the same numerical designation.

As used herein, the terms "comprising," "including," "containing," and grammatical equivalents thereof are inclusive or open-ended terms that do not exclude additional, unrecited elements or method steps, but also include the more restrictive terms "consisting of" and "consisting essentially of" and grammatical equivalents thereof. As used herein, the term "may" with respect to a material, structure, feature, or method act indicates that such is contemplated for use in implementation of an embodiment of the disclosure and such term is used in preference to the more restrictive term "is" so as to avoid any implication that other, compatible materials, structures, features, and methods usable in combination therewith should or must be excluded.

As used herein, the terms "longitudinal", "vertical", "lateral," and "horizontal" are in reference to a major plane of a substrate (e.g., base material, base structure, base construction, etc.) in or on which one or more structures and/or features are formed and are not necessarily defined by earth's gravitational field. A "lateral" or "horizontal" direction is a direction that is substantially parallel to the major plane of the substrate, while a "longitudinal" or "vertical" direction is a direction that is substantially perpendicular to the major plane of the substrate. The major plane of the substrate is defined by a surface of the substrate having a relatively large area compared to other surfaces of the substrate.

As used herein, spatially relative terms, such as "beneath," "below," "lower," "bottom," "above," "over," "upper," "top," "front," "rear," "left," "right," and the like, may be used for ease of description to describe one element's or feature's relationship to another element(s) or feature(s) as illustrated in the figures. Unless otherwise specified, the spatially relative terms are intended to encompass different orientations of the materials in addition to the orientation depicted in the figures. For example, if materials in the figures are inverted, elements described as "over" or "above" or "on" or "on top of" other elements or features would then be oriented "below" or "beneath" or "under" or "on bottom of" the other elements or features. Thus, the term "over" can encompass both an orientation of above and below, depending on the context in which the term is used, which will be evident to one of ordinary skill in the art. The materials may be otherwise oriented (e.g., rotated 90 degrees, inverted, flipped) and the spatially relative descriptors used herein interpreted accordingly.

As used herein, the singular forms "a," "an," and "the" are intended to include the plural forms as well, unless the context clearly indicates otherwise.

As used herein, the term "and/or" includes any and all combinations of one or more of the associated listed items.

As used herein, the term "configured" refers to a size, shape, material composition, orientation, and arrangement of one or more of at least one structure and at least one apparatus facilitating operation of one or more of the structure and the apparatus in a predetermined way.

As used herein, the term "substantially" in reference to a given parameter, property, or condition means and includes to a degree that one of ordinary skill in the art would understand that the given parameter, property, or condition is met with a degree of variance, such as within acceptable manufacturing tolerances. By way of example, depending on the particular parameter, property, or condition that is substantially met, the parameter, property, or condition may be at least 90.0% met, at least 95.0% met, at least 99.0% met, or even at least 99.9% met.

As used herein, the term "about" in reference to a given parameter is inclusive of the stated value and has the meaning dictated by the context (e.g., it includes the degree of error associated with measurement of the given parameter).

As used herein, the terms "earth-boring tool" and "earth-boring drill bit" mean and include any type of bit or tool used for drilling during the formation or enlargement of a wellbore in a subterranean formation and include, for example, fixed-cutter bits, roller cone bits, percussion bits, core bits, eccentric bits, bi-center bits, reamers, mills, drag bits, hybrid bits (e.g., rolling components in combination with fixed cutting elements), and other drilling bits and tools known in the art.

As used herein, the term "polycrystalline compact" means and includes any structure comprising a polycrystalline material formed by a process that involves application of pressure (e.g., compaction) to the precursor material or materials used to form the polycrystalline material. In turn, as used herein, the term "polycrystalline material" means and includes any material comprising a plurality of grains or crystals of the material that are bonded directly together by inter-granular bonds. The crystal structures of the individual grains of the material may be randomly oriented in space within the polycrystalline material. Non-limiting examples of polycrystalline compacts include synthetic polycrystalline diamond and cubic boron nitride.

As used herein, the term "inter-granular bond" means and includes any direct atomic bond (e.g., covalent, metallic, etc.) between atoms in adjacent grains of hard material.

As used herein, the term "hard material" means and includes any material having a Knoop hardness value of greater than or equal to about 3,000 $Kg_f/mm^2$ (29,420 MPa). Non-limiting examples of hard materials include diamond (e.g., natural diamond, synthetic diamond, or combinations thereof), and cubic boron nitride. Synthetic polycrystalline diamond and cubic boron nitride are non-limiting examples of polycrystalline compacts comprising hard materials.

FIG. 1 is a perspective view of a cutting element 100, in accordance with an embodiment of the disclosure. The cutting element 100 includes a cutting table 104 secured (e.g., attached, bonded, etc.) to a supporting substrate 102 at an interface 106. The supporting substrate 102 may be formed of and include a material that is relatively hard and resistant to wear. By way of non-limiting example, the supporting substrate 102 may be formed from and include a ceramic-metal composite material (also referred to as a "cermet" material). In some embodiments, the supporting substrate 102 is formed of and includes a cemented carbide material, such as a cemented tungsten carbide material, in which tungsten carbide particles are cemented together by a metallic binder material. As used herein, the term "tungsten carbide" means any material composition that contains chemical compounds of tungsten and carbon, such as, for example, WC, $W_2C$, and combinations of WC and $W_2C$. Tungsten carbide includes, for example, cast tungsten carbide, sintered tungsten carbide, and macrocrystalline tungsten carbide. The metallic binder material may include, for example, a metal-solvent catalyst material useful in catalyzing the formation of inter-granular bonds between diamond grains in the manufacture of polycrystalline diamond compacts. Such metal-solvent catalyst materials include, for example, cobalt, nickel, iron, and alloys and mixtures thereof. In some embodiments, the supporting substrate 102 is formed of and includes a cobalt-cemented tungsten carbide material.

The supporting substrate 102 may exhibit any peripheral geometric configuration (e.g., peripheral shape and peripheral size) facilitating desired reception of the supporting substrate 102 within a complementary recess (e.g., pocket, opening, blind via, etc.) in an earth-boring tool, as described in further detail below. The peripheral geometric configuration of the supporting substrate 102 may, for example, allow the supporting substrate 102 to be provided in the complementary recess in the earth-boring tool such that one or more features of the cutting table 104 exhibit desirable orientation relative to one or more other components of the earth-boring tool, and such that the features of the cutting table 104 exhibit desirable interaction (e.g., engagement) with a subterranean formation during use and operation of the earth-boring tool. By way of non-limiting example, as shown in FIG. 1, the supporting substrate 102 may exhibit a 3D, laterally elongate geometry (e.g., a non-circular column geometry) including a substantially consistent (e.g., non-variable) lateral cross-sectional shape and substantially consistent lateral cross-sectional dimensions throughout a longitudinal thickness (e.g., height) thereof.

Figure 2:
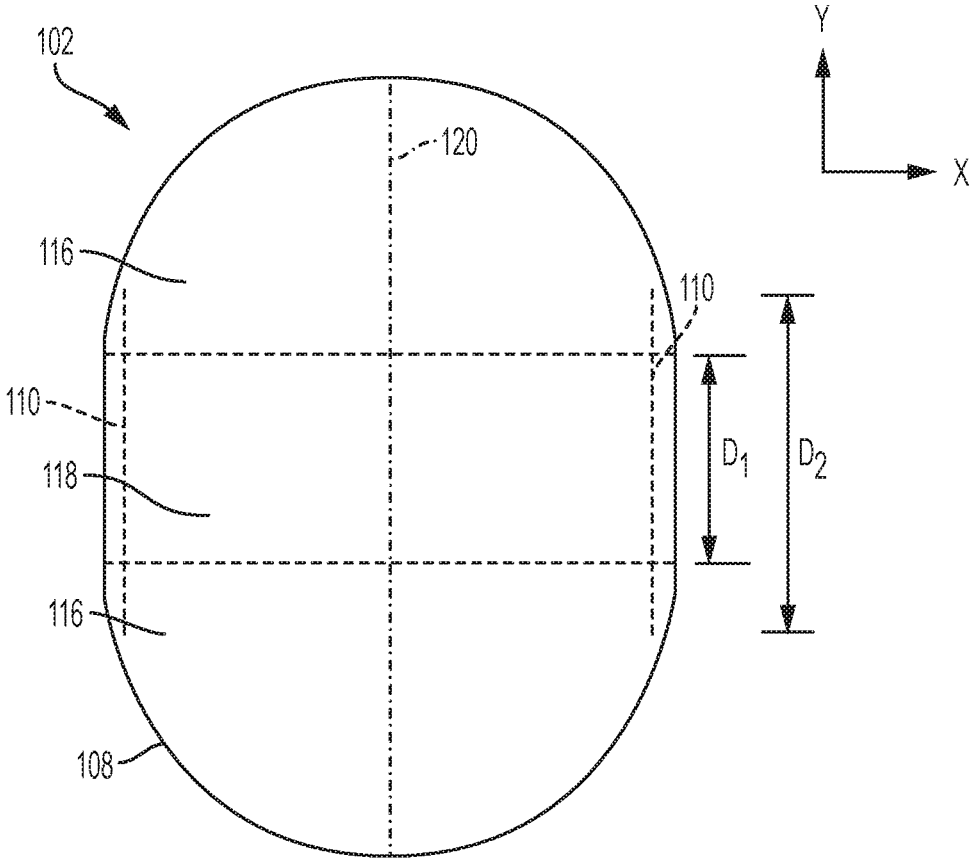
FIG. 2 is a top-down view of the substrate of the cutting element shown in FIG. 1, in accordance with an embodiment of the disclosure.

FIG. 2 is a top-down view of the supporting substrate 102 of the cutting element 100 shown in FIG. 1. As shown in FIG. 2, the supporting substrate 102 may exhibit a non-circular lateral cross-sectional shape including opposing semicircular regions 116 and a rectangular region 118 intervening between the opposing semicircular regions 116. Each of the opposing semicircular regions 116 and the rectangular region 118 may be laterally centered (e.g., in the X-direction) about a central longitudinal plane 120 (shown as a dashed line in FIG. 2) of the supporting substrate 102, and may exhibit substantially the same radius as one another. The rectangular region 118 may also be laterally centered (e.g., in the X-direction) about the central longitudinal plane 120 of the supporting substrate 102, and may separate (e.g., in the Y-direction) the opposing semicircular regions 116 by a distance $D_1$. The distance $D_1$ between the opposing semicircular regions 116 may be any distance that facilitates self-alignment of one or more features of the cutting element 100 (FIG. 1) (e.g., one or more features of the cutting table 104 (FIG. 1), as described in further detail below. The distance $D_1$ between the opposing semicircular regions 116 may, for example, be less than or equal to the radius of each of the semicircular regions 116. By way of non-limiting example, a ratio of a magnitude of the distance $D_1$ between the opposing semicircular regions 116 to a magnitude of the radius of each of the semicircular regions 116 may be within a range of from about 1:1 to about 1:10 (e.g., from about 1:1 to about 1:5, from about 1:2 to about 1:4, from about 1:2 to about 1:3, etc.). In some embodiments, a ratio of a magnitude of the distance $D_1$ between the opposing semicircular regions 116 to a magnitude of the radius of each of the semicircular regions 116 is about 1:2.57. As shown in FIG. 2, peripheral portions of the opposing semicircular regions 116 and the rectangular region 118 may define a sidewall 108 (e.g., outer side surface) of the supporting substrate 102. In FIG. 2, dashed lines are provided between the opposing semicircular regions 116 and the rectangular region 118 to identify (e.g., delineate, distinguish, etc.) the opposing semicircular regions 116 from the rectangular region 118. However, it will be understood that the rectangular region 118 is integral and continuous with each opposing semicircular regions 116.

As shown in FIG. 2, optionally, one or more vent flats 110 may be formed in the sidewall 108 of the supporting substrate 102. The vent flats 110 (if present), may be formed by removing peripheral portions of the rectangular region 118 of the supporting substrate 102, as well as peripheral portions of the opposing semicircular regions 116 proximate (e.g., adjacent) the peripheral portions of the rectangular region 118. Accordingly, the vent flats 110 may decrease an overall width (e.g., in the X-direction) of the supporting substrate 102, and may increase lengths (e.g., in the Y-direction) of flat (planar, non-arcuate, etc.) regions along the sidewall 108 of the supporting substrate 102. For example, as shown in FIG. 2, a distance $D_2$ between ends (e.g., in the Y-direction) of the vent flats 110 may be greater than the distance $D_1$ between ends (e.g., in the Y-direction) of the rectangular region 118 of the supporting substrate 102. The vent flats 110 (if present), in conjunction with the geometric configuration of a pocket (e.g., opening, via, etc.) in an earth-boring tool to receive at least the supporting substrate 102, may facilitate the release (e.g., escape) of one or more materials (e.g., gases, such as air; a braze material employed for bonding the supporting substrate 102 within the pocket; etc.) from the pocket in the earth-boring tool during placement of the supporting substrate 102 within the pocket. In some embodiments, the supporting substrate 102 includes the vent flats 110 formed therein. In additional embodiments, the supporting substrate 102 does not include the vent flats 110 formed therein (e.g., the supporting substrate 102 only exhibits flat regions along the sidewall 108 corresponding to peripheral portions of the rectangular region 118 of the supporting substrate 102).

In additional embodiments, the supporting substrate 102 may exhibit a different peripheral geometric configuration than that depicted in FIGS. 1 and 2, so long as the peripheral geometric configuration facilitates desired reception of at least the supporting substrate 102 within a complementary recess in an earth-boring tool. For example, the supporting substrate 102 may comprise a 3D structure exhibiting a substantially consistent lateral cross-sectional shape but variable (e.g., non-consistent, such as increasing and/or decreasing) lateral cross-sectional dimensions throughout the longitudinal thickness thereof, may comprise a 3D structure exhibiting a different substantially consistent lateral cross-sectional shape (e.g., an elliptical shape, a tear drop shape, a semicircular shape, a tombstone shape, a crescent shape, a triangular shape, a rectangular shape, a kite shape, an irregular shape, etc.) and substantially consistent lateral cross-sectional dimensions throughout the longitudinal thickness thereof, or may comprise a 3D structure exhibiting a variable lateral cross-sectional shape and variable lateral cross-sectional dimensions throughout the longitudinal thickness thereof. In some of such embodiments, the supporting substrate 102 may include vent flats. In other of such embodiments, vent flats may be omitted from the supporting substrate 102.

Referring again to FIG. 1, the cutting table 104 may be positioned on or over the supporting substrate 102, and includes at least one sidewall 112 (e.g., side surface), and a cutting face 114 adjacent the sidewall 112. The cutting table 104 may be formed of and include at least one hard material, such as at least one polycrystalline material. In some embodiments, the cutting table 104 is formed of and includes a PCD material. For example, the cutting table 104 may be formed from diamond particles (also known as "diamond grit") mutually bonded in the presence of at least one catalyst material (e.g., at least one Group VIII metal, such as one or more of cobalt, nickel, and iron; at least one alloy including a Group VIII metal, such as one or more of a cobalt-iron alloy, a cobalt-manganese alloy, a cobalt-nickel alloy, cobalt-titanium alloy, a cobalt-nickel-vanadium alloy, an iron-nickel alloy, an iron-nickel-chromium alloy, an iron-manganese alloy, an iron-silicon alloy, a nickel-chromium alloy, and a nickel-manganese alloy; combinations thereof; etc.). The diamond particles may comprise one or more of natural diamond and synthetic diamond, and may include a monomodal distribution or a multimodal distribution of particle sizes. In additional embodiments, the cutting table 104 is formed of and includes a different polycrystalline material, such as one or more of polycrystalline cubic boron nitride, a carbon nitride, and another hard material known in the art.

The cutting table 104 may exhibit any desired peripheral geometric configuration (e.g., peripheral shape and peripheral size). The peripheral geometric configuration of the cutting table 104 may be selected relative to a desired position of the cutting element 100 on an earth-boring tool to provide the cutting table 104 with desired interaction (e.g., engagement) with a subterranean formation during use and operation of the earth-boring tool. For example, the shape of the cutting table 104 may be selected to facilitate one or more of shearing, crushing, and gouging of the subterranean formation during use and operation of the earth-boring tool. The cutting table 104 may exhibit a substantially consistent lateral cross-sectional shape but variable lateral cross-sectional dimensions throughout a longitudinal thickness thereof, may exhibit a different substantially consistent lateral cross-sectional shape and substantially consistent lateral cross-sectional dimensions throughout the longitudinal thickness thereof, or may exhibit a variable lateral cross-sectional shape and variable lateral cross-sectional dimensions throughout the longitudinal thickness thereof. By way of non-limiting example, the cutting table 104 may exhibit a chisel shape, a frustoconical shape, a conical shape, a dome shape, an elliptical cylinder shape, a rectangular cylinder shape, a circular cylinder shape, a pyramidal shape, a frusto pyramidal shape, a fin shape, a pillar shape, a stud shape, a truncated version of one of the foregoing shapes, or a combination of two or more of the foregoing shapes. Accordingly, the cutting table 104 may have any desired lateral cross-sectional shape including, but not limited to, an elliptical shape, a circular shape, a tetragonal shape (e.g., square, rectangular, trapezium, trapezoidal, parallelogram, etc.), a triangular shape, a semicircular shape, an ovular shape, a semicircular shape, a tombstone shape, a tear drop shape, a crescent shape, or a combination of two or more of the foregoing shapes. The peripheral shape of cutting table 104 may be symmetric, or may be asymmetric. In some embodiments, the cutting table 104 exhibits a non-axis-symmetrical shape, such that a shape of the cutting table 104 extending away from a central axis of the cutting table 104 in one lateral direction (e.g., the X-direction) is different than a shape of the cutting table 104 extending away the central axis of the cutting table 104 in another lateral direction (e.g., the Y-direction).

The cutting table 104 may be formed using one or more conventional processes, which are not described in detail herein. As a non-limiting example, particles (e.g., grains, crystals, etc.) formed of and including one or more hard materials may be provided within a container in the shape of the cutting table 104, and then the particles may be subjected to a high temperature, high pressure (HTHP) process to sinter the particles and form the cutting table 104. One example of an HTHP process for forming the cutting table 104 may comprise pressing the particles within the container using a heated press at a pressure of greater than about 5.0 GPa and at temperatures greater than about 1,400° C., although the exact operating parameters of HTHP processes will vary depending on the particular compositions and quantities of the various materials being used. The pressures in the heated press may be greater than about 6.5 GPa (e.g., about 7 GPa), and may even exceed 8.0 GPa in some embodiments. Furthermore, the material (e.g., particles) being sintered may be held at such temperatures and pressures for a time period between about 30 seconds and about 20 minutes. As another non-limiting example, particles formed of and including one or more hard materials may be provided within a container in a first shape, the particles may be subjected to an HTHP process to sinter the particles and form a preliminary cutting table exhibiting the first shape, and then the preliminary cutting table may be subjected to at least one material removal process (e.g., an electric discharge machining (EDM) process, a laser cutting process, a water jet cutting process, another cutting process, another machining process, etc.) to form the cutting table 104. By way of non-limiting example, one or more of the cutting table 104 may be formed from a preliminary cutting table through at least one laser cutting process such as, for example, a laser cutting process described in U.S. Pat. No. 9,259,803, issued Feb. 16, 2016, to DiGiovanni, the entire disclosure of which is hereby incorporated herein by this reference.

The supporting substrate 102 may be attached to the cutting table 104 during or after the formation of the cutting table 104. In some embodiments, the supporting substrate 102 is attached to the cutting table 104 during the formation of the cutting table 104. For example, particles formed of and including one or more hard materials may be provided within a container in the shape of the cutting table 104, the supporting substrate 102 may be provided on or over the particles, and then the particles and the supporting substrate 102 may be subjected to an HTHP process to form the cutting element 100 including the supporting substrate 102 attached to the cutting table 104. As another example, particles formed of and including one or more hard materials may be provided within a container in a first shape, the supporting substrate 102 may be provided over the particles, the particles and the supporting substrate 102 may be subjected to a HTHP process to form a preliminary structure including a preliminary cutting table attached to the supporting substrate 102, and then the preliminary cutting table may be subjected to at least one material removal process to form the cutting table 104 (and, hence, the cutting element 100). In additional embodiments, the supporting substrate 102 is attached to the cutting table 104 after the formation of the cutting table 104. For example, the cutting table 104 may be formed separate from the supporting substrate 102 through one or more processes (e.g., molding processes, HTHP processes, material removal processes, etc.), and then the cutting table 104 may be attached to the supporting substrate 102 through one or more additional processes (e.g., additional HTHP processes, etc.) to form the cutting element 100.

With continued reference to FIG. 1, the interface 106 between the supporting substrate 102 and the cutting table 104 (and, hence, opposing surfaces of the supporting substrate 102 and the cutting table 104) may be substantially planar, or may be at least partially non-planar (e.g., curved, angled, jagged, sinusoidal, V-shaped, U-shaped, irregularly shaped, combinations thereof, etc.). In some embodiments, the interface 106 between the supporting substrate 102 and the cutting table 104 is substantially planar. In additional embodiments, the interface 106 between the supporting substrate 102 and the cutting table 104 is substantially non-planar. Furthermore, each region of the sidewall 108 of the supporting substrate 102 may be substantially coplanar with each region of the sidewall 112 of the cutting table 104 most proximate thereto, or at least one region of the sidewall 108 of the supporting substrate 102 may be non-planar with at least one region of the sidewall 112 of the cutting table 104 most proximate thereto. As shown in FIG. 1, in some embodiments, each region of the sidewall 108 of the supporting substrate 102 is substantially coplanar with each region of the sidewall 112 of the cutting table 104 most proximate thereto.

Figure 3:
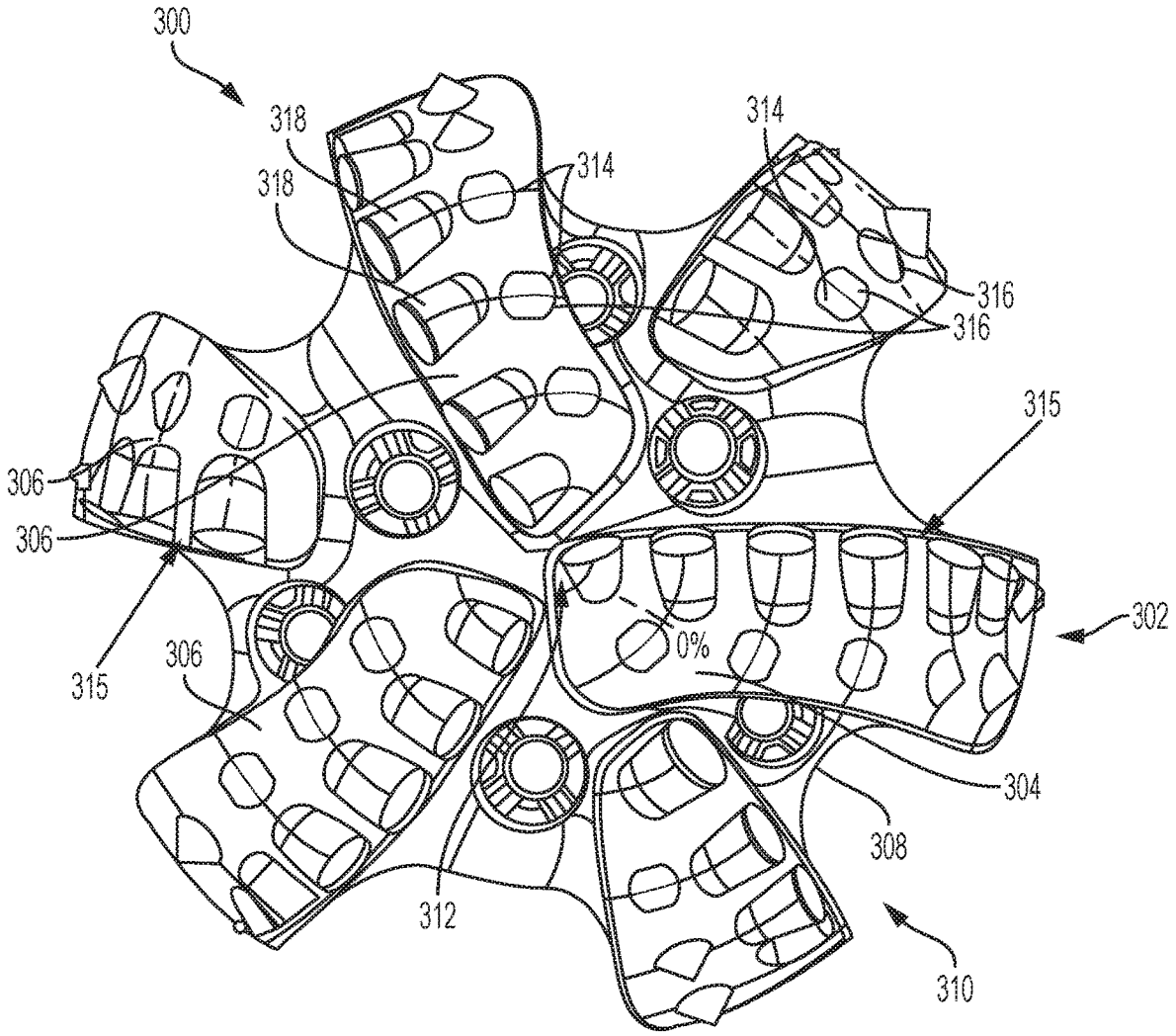
FIG. 3 is a face view of a rotary drill bit, in accordance with an embodiment of the disclosure.

Embodiments of the cutting elements (e.g., the cutting element 100) described herein may be secured to an earth-boring tool and used to remove material of a subterranean formation. As a non-limiting example, FIG. 3 shows a face view of a rotary drill bit 300 in the form of a fixed cutter or so-called "drag" bit, according to an embodiment of the disclosure. The rotary drill bit 300 includes a body 302 exhibiting a face 304 defined by external surfaces of the body 302 that may contact a subterranean formation during drilling operations. The body 302 may comprise, by way of example and not limitation, an infiltrated tungsten carbide body, a steel body, or a sintered particle matrix body, and may include a plurality of blades 306 extending longitudinally and radially over the face 304 in a spiraling configuration relative to a rotational axis 312 of the rotary drill bit 300. The blades 306 may receive and hold cutting elements 314 within pockets 316, and may define fluid courses 308 therebetween extending into junk slots 310 between gage sections of circumferentially adjacent blades 306. One or more of the cutting elements 314 may be substantially similar to the cutting element 100 previously described herein with respect to FIG. 1. Each of the cutting elements 314 may be substantially the same as each other of the cutting elements 314, or at least one of the cutting elements 314 may be different than at least one other of the cutting elements 314. The cutting elements 314 may be secured within the pockets 316 in the blades 306 of the rotary drill bit 300 by, for example, brazing, mechanical interference, welding, and/or other attachment means known in the art.

As shown in FIG. 3, in some embodiments, the cutting elements 314 are provided as backup (e.g., secondary) cutting elements of the rotary drill bit 300. For example, the cutting elements 314 may rotationally trail additional cutting elements 318 (i.e., the additional cutting elements 318 may rotationally lead the cutting elements 314) within additional pockets 319 in the blades 306 during use and operation of the rotary drill bit 300. Each of the cutting elements 314 may independently be provided on the same blade 306 as the additional cutting element 318 that the cutting element 314 directly rotationally trails. In addition, each of the cutting elements 314 may independently be provided at substantially the same radial distance from the rotational axis 312 of the rotary drill bit 300 as the additional cutting element 318 that the cutting element 314 directly rotationally trails. The cutting elements 314 and the additional cutting elements 318 may be positioned to travel in at least one spiral (e.g., helical) path during rotation of the rotary drill bit 300 in a borehole as the rotary drill bit 300 extends the borehole being drilled into a subterranean formation. The cutting elements 314 and the additional cutting element 318 may have equal or differing exposures (i.e., the distance(s) the cutting elements 314 and the additional cutting element 318 extend above the blades 306 to which they are attached), and may have substantially the same or differing backrake and/or siderake angles.

In some embodiments, at least some (e.g., each) of the cutting elements 314 are configured (e.g., sized, shaped, oriented, etc.) to gouge surfaces of a subterranean formation during use and operation of the rotary drill bit 300, and at least some (e.g., each) of the additional cutting elements 318 are configured (e.g., sized, shaped, oriented, etc.) to shear surfaces of the subterranean formation during use and operation of the rotary drill bit 300. For example, one or more (e.g., each) of the cutting elements 314 may independently include a cutting table (e.g., the cutting table 104 shown in FIG. 1) exhibiting a non-planar cutting face shape (e.g., the asymmetric, non-planar shape of the cutting face 114 shown in FIG. 1), and one or more (e.g., each) of the additional cutting elements 318 may independently include a cutting table exhibiting a substantially planar cutting face shape.

The cutting elements 314 may be configured to cut kerfs having centers substantially aligned with centers of grooves formed by the additional cutting elements 318 directly rotationally leading the cutting elements 314. Accordingly, features (e.g., centers, cutting surfaces, cutting edges, etc.) of non-planar cutting faces of the cutting tables of the cutting elements 314 may be substantially aligned with features (e.g., centers, cutting surfaces, cutting edges, etc.) of substantially planar cutting faces of the additional cutting elements 318 directly rotationally leading the cutting elements 314. The alignment of features of the non-planar cutting faces of cutting elements 314 may be facilitated by the geometric configurations (e.g., shapes and sizes) of the supporting substrates (e.g., the supporting substrate 102 shown in FIGS. 1 and 2) of the cutting elements 314 and the configurations (e.g., shapes and sizes) and positions of the pockets 316 in which at least the supporting substrates are provided, as described in further detail below. The alignment of features of the non-planar cutting faces of the cutting elements 314 may increase the stability of the rotary drill bit 300 and render the rotary drill bit 300 self-centering (e.g., able to drill an at least substantially vertical borehole). The alignment of features of the non-planar cutting faces of the cutting elements 314 may, for example, allow the cutting elements 314 to resist undesired torsional movement (e.g., rotation, twisting, etc.) during use and operation of the rotary drill bit 300 that may otherwise negatively impact the stability of the rotary drill bit 300 during such use and operation.

As shown in FIG. 3, the cutting elements 314 (and, hence, the pockets 316 in which the cutting elements 314 are provided), may outwardly extend in different directions than the additional cutting elements 318 (and, hence, the additional pockets 319 holding the additional cutting elements 318) directly rotationally leading the cutting elements 314. For example, the additional cutting elements 318 (and, hence, the additional pockets 319 holding the additional cutting elements 318) may outwardly extend toward leading edges 315 of the blades 306, and the cutting elements 314 may outwardly extend toward surfaces 317 of the blades 306 rotationally trailing the leading edges 315 of the blades 306. Sidewalls of supporting substrates (e.g., the supporting substrate 102 shown in FIGS. 1 and 2) of the cutting elements 314 may be substantially (e.g., completely) surrounded by the pockets 316 in the blades 306, whereas sidewalls of supporting substrates of the additional cutting elements 318 may only be partially surrounded by the additional pockets 319 in the blades 306. The supporting substrates of the cutting elements 314 may, for example, be completely contained within boundaries of the pockets 316 in the blades 306, wherein the supporting substrates of the additional cutting elements 318 may only be partially contained within boundaries of the additional pockets 319 in the blades 306.

The pockets 316 in the blades 306 of the rotary drill bit 300 may exhibit geometric configurations (e.g., shapes and sizes) complementary to geometric configurations of supporting substrates (e.g., the supporting substrate 102 shown in FIGS. 1 and 2) of the cutting elements 314 held therein. The geometric configurations of the pockets 316 relative to geometric configurations of supporting substrates of the cutting elements 314 may facilitate desired orientation of one or more features (e.g., cutting face features, such as cutting surfaces and cutting edges) of cutting tables (e.g., the cutting table 104 shown in FIG. 1) of the cutting elements 314 to ensure proper interaction between the cutting tables of the cutting elements 314 and a subterranean formation to be drilled using the rotary drill bit 300. The geometric configurations of the pockets 316 relative to geometric configurations of the supporting substrates of the cutting elements 314 may facilitate such desired orientation without the need for additional features (e.g., alignment features, such as bumps, holes, grooves, etc.), marks, and/or tools. Put another way, the geometric configurations of the pockets 316 relative to geometric configurations of supporting substrates of the cutting elements 314 may facilitate the self-alignment of features of the cutting tables of the cutting elements 314.

Figure 4:
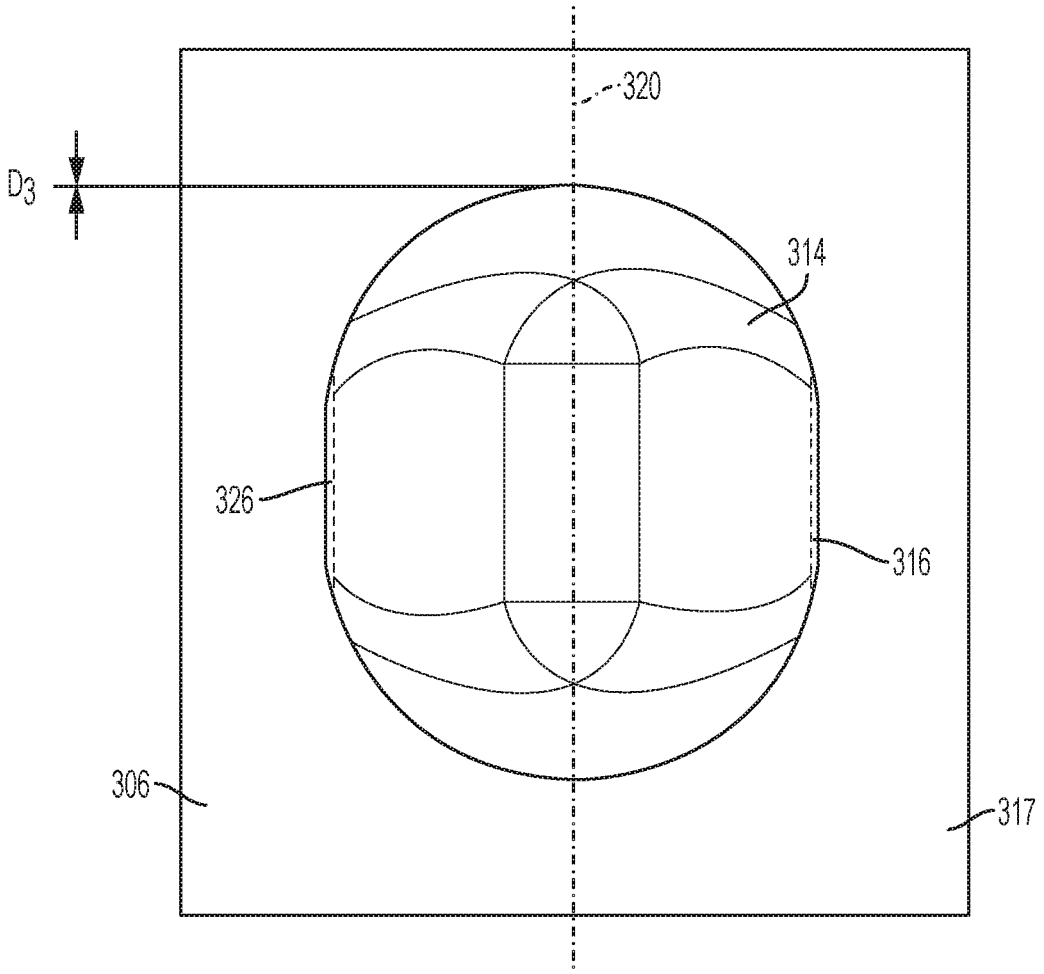
FIG. 4 is a top-down view of the cutting element shown in FIG. 1 in a pocket of the rotary drill bit shown in FIG. 3, in accordance with an embodiment of the disclosure.

Referring to FIG. 4, which shows an enlarged, top-down view of a portion of the rotary drill hit 300 shown in FIG. 3, at least one of the pockets 316 in one or more of the blades 306 may exhibit a geometric configuration (e.g., shape and size) permitting the supporting substrate of the cutting element 314 to be provided therein. As shown in FIG. 4, the pocket 316 may exhibit a lateral cross-sectional shape and lateral cross-sectional dimensions allowing the pocket 316 in receive and surround the supporting substrate (e.g., the supporting substrate 102 shown in FIGS. 1 and 2) of the cutting element 314 with little to no gap (e.g., void space) between lateral boundaries of the pocket 316 and lateral boundaries of one or more regions of the supporting substrate. By way of non-limiting example, in some embodiments, the pocket 316 laterally surrounds opposing semicircular regions (e.g., the opposing semicircular regions 116 shown in FIG. 2) of the supporting substrate of the cutting element 314 with little to no gap therebetween. A magnitude of a distance D3 between the pocket 316 and the supporting substrate at the opposing semicircular regions of the supporting substrate may, for example, be less than or equal to about 0.007 inch (e.g., less than or equal to about 0.006 inch. less than or equal to about 0.005 inch, less than or equal to about 0.004 inch, less than or equal to about 0.003 inch, less than or equal to about 0.002 inch, less than or equal to about 0.001 inch, or less than or equal to about 0.0005 inch). Optionally, one or more relatively larger gaps may be present between the pocket 316 and one or more other regions (e.g., nonsemicircular regions) of the supporting substrate of the cutting element 314. For example, as shown in FIG. 4, one or more gaps may be present between the pocket 316 and one or more vent flats 326 (if present) of the supporting substrate of the cutting element 314. The gaps between the pocket 316 and the vent flats 326 (if present) of the supporting substrate may facilitate the release of one or more materials (e.g., gases, such as air; a braze material; etc.) from the pocket 316 during placement of at least the supporting substrate of the cutting element 314 within the pocket 316. As a result of the complementary geometric configurations of the pocket 316 and the supporting substrate of the cutting element 314 therein, the pocket 316 and the cutting element 314 may exhibit substantially the same central longitudinal plane 320 (i.e., a central longitudinal plane of the cutting element 314 may be substantially aligned with a central longitudinal plane of the pocket 316 in which the cutting element 314 is held).

Figure 5:
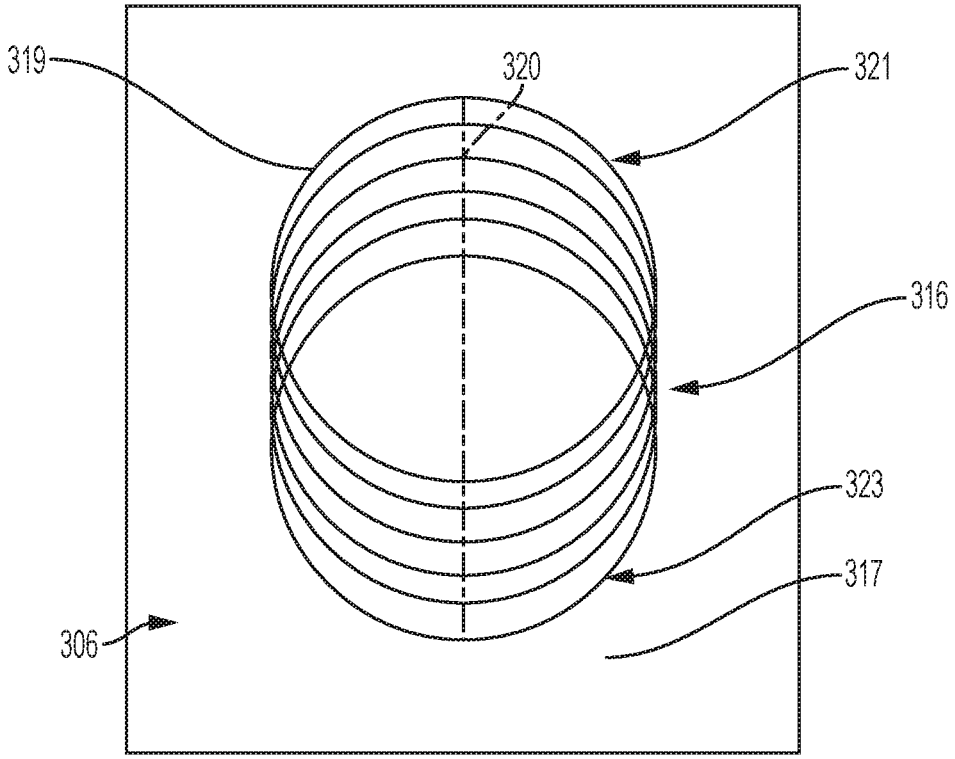
FIG. 5 is a top-down view illustrating a method of forming the pocket shown in FIG. 4, in accordance with an embodiment of the disclosure.

The pockets 316 may be formed using one or more processes, such as one or more of a straight path milling process, an orbital milling process, a plunge electric discharge machining (EDM) process, and a casting process. In some embodiments, one or more of the pockets 316 may be machined into the blades 306 using a straight path milling process. For example, referring to FIG. 5, which shows an enlarged, top-down view of a portion of the rotary drill bit 300 shown in FIG. 3 during a process of forming one of the pockets 316 therein, an initial opening (e.g., an initial pocket) having a circular lateral cross-sectional shape may be formed into the surface 317 of one of the blades 306 at a first position 321 using a correspondingly-shaped cutting structure of a milling tool (e.g., a cutting structure exhibiting substantially the same circular lateral cross-sectional shape). The initial opening may, for example, be machined into the blade 306 using the processes and equipment disclosed one or more of U.S. Pat. No. 5,333,699, issued Aug. 2, 1994, to Thigpen et al., and U.S. Patent Application Pub. No. 2008/0223622, published Sep. 18, 2008, to Duggan et al., the disclosure of each of which is incorporated herein in its entirety by this reference. Thereafter, the shape and dimensions of the initial opening may be modified to the dimensions and shape of the pocket 316 by continuing to engage the blade 306 with the cutting structure of the milling tool while simultaneously moving the cutting structure in a straight path to a second position 323 to remove additional material of the blade 306 and form regions of the pocket 316 complementary to the regions (e.g., the opposing semicircular regions 116 and the rectangular region 118 shown in FIG. 2) of the supporting substrate of the cutting element 314 (FIG. 4) to be provided therein. In further embodiments, one or more of the pockets 316 may be formed during formation of the bit body 302 (FIG. 3), such as, for example, by placing displacements (e.g., 3D, laterally elongate displacements) at locations for the pockets 316 in a mold, forming the bit body 302 (FIG. 3) and the blades 306 in the mold around the displacements, and removing the displacements, as disclosed in U.S. Pat. No. 7,841,259, issued Nov. 30, 2010, to Smith et al., the disclosure of which is incorporated herein in its entirety by this reference.

Figure 6:
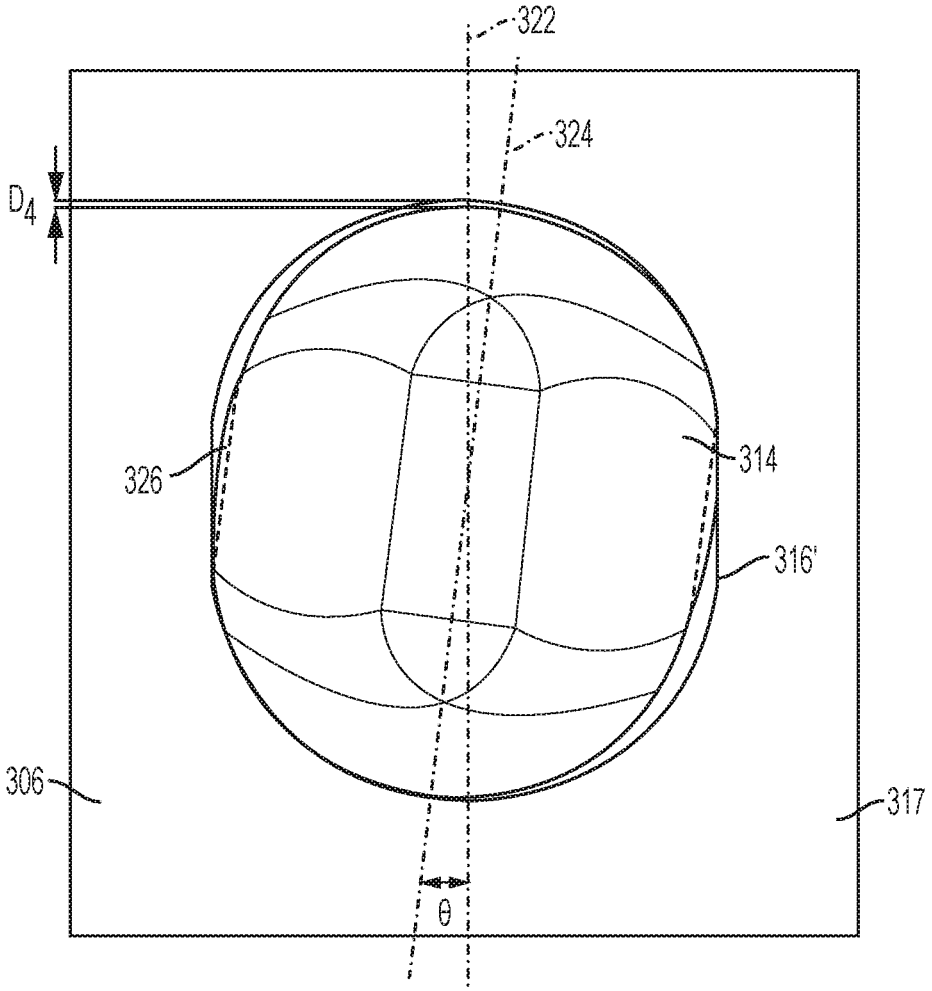
FIG. 6 is a top-down view of the cutting element shown in FIG. 1 in a pocket of the rotary drill bit shown in FIG. 3, in accordance with another embodiment of the disclosure

In additional embodiments, one or more of the pockets 316 in one or more of the blades 306 may exhibit a different configuration (e.g., shape and/or size) than that depicted in FIG. 4. For example, in accordance with additional embodiments of the disclosure. FIG. 6 shows an enlarged, top-down view of a portion of the rotary drill hit 300 shown in FIG. 3. As shown in FIG. 6, at least one pocket 316' in at least one of the blades 306 may exhibit a geometric configuration (e.g., shape and size) different than the geometric configuration of the pocket 316 shown in FIG. 4. The pocket 316' may, for example, exhibit a lateral cross-sectional shape and lateral cross-sectional dimensions permitting the pocket 316' to receive and surround the supporting substrate of the cutting element 314, but the lateral cross-sectional dimensions of the pocket 316' may result in gaps between lateral boundaries of the pocket 316' and lateral boundaries of one or more regions of the supporting substrate that are larger than those present in the embodiment depicted in FIG. 4. By way of non-limiting example, in some embodiments, the pocket 316' laterally surrounds opposing semicircular regions (e.g., the opposing semicircular regions 116 shown in FIG. 2) of the supporting substrate of the cutting element 314, but a magnitude of a distance D4 between the pocket 316' and the supporting substrate at the opposing semicircular regions of the supporting substrate may be greater than the magnitude of the distance D3 between the pocket 316 and the opposing semicircular regions of the supporting substrate shown in FIG. 4. As a result of the geometric configuration of the pocket 316, a central longitudinal plane 322 of the pocket 316' may exhibit a different orientation than a central longitudinal plane 324 of the cutting element 314 therein. For example, the cutting element 314 and the pocket 316' may share a common lateral center, but the central longitudinal plane 324 of the cutting element 314 may be offset from the central longitudinal plane 322 of the pocket 316' by an angle θ. A magnitude of the angle θ between the central longitudinal plane 324 of the cutting element 314 and the central longitudinal plane 322 of the pocket 316' may be less than or equal to about five (5) degrees (e.g., less than or equal to about four (4) degrees, less than or equal to about three (3) degrees, less than or equal to about two (2) degrees, less than or equal to about one (1) degree, etc.). The increased lateral cross-sectional dimensions of the pocket 316' as compared to the pocket 316 shown in FIG. 4 may enhance the ease of providing the cutting element 314 into the pocket 316'.

During use and operation, the rotary drill bit 300 may be rotated about the rotational axis 312 thereof in a borehole extending into a subterranean formation. As the rotary drill bit 300 rotates, at least some of the additional cutting elements 318 in rotationally leading positions across the blades 306 of the bit body 302 may engage surfaces of the borehole with cutting faces thereof and remove (e.g., shear, cut, etc.) portions of the subterranean formation. Thereafter, at least some of the cutting elements 314 aligned with and rotationally trailing the additional cutting elements 318 on the blades 306 of the bit body 302 may engage the surfaces of the borehole with the cutting faces thereof and remove (e.g., gouge, crush, etc.) additional portions of the subterranean formation.

The cutting elements (e.g., the cutting elements 100, 314) and earth-boring tools (e.g., the rotary drill bit 300) of the disclosure may exhibit increased performance, reliability, and durability as compared to conventional cutting elements and conventional earth-boring tools. The configurations of the cutting elements facilitate and maintain desirable orientation and alignment of features of the cutting elements, facilitating consistent and selective formation engagement during use and operation of the earth-boring tools. The peripheral geometric configurations of supporting substrates of the cutting elements relative to the geometric configurations of pockets within the earth-boring tools facilitate the consistent self-alignment of features (e.g., non-axis symmetrical features, such as non-axis symmetrical cutting faces) of cutting tables of the cutting elements relative to other components of the earth-boring tools. The peripheral geometric configurations of supporting substrates of the cutting elements relative to the geometric configurations of the pockets may substantially limit or even prevent undesirable rotation of the cutting elements within the pockets, allowing features of the cutting elements to maintain desirable orientations during use and operation of the earth-boring tools. The cutting elements, earth-boring tools, and methods of the disclosure may provide enhanced drilling efficiency as compared to conventional cutting elements, conventional earth-boring tools, and conventional methods.

While the disclosure is susceptible to various modifications and alternative forms, specific embodiments have been shown by way of example in the drawings and have been described in detail herein. However, the disclosure is not intended to be limited to the particular forms disclosed. Rather, the disclosure is to cover all modifications, equivalents, and alternatives falling within the scope of the disclosure as defined by the following appended claims and their legal equivalents.

What is claimed is:

1. A cutting element, comprising:

a three-dimensional, laterally elongate supporting substrate exhibiting at least one vent flat in a sidewall thereof, a lateral cross-sectional shape of the three-dimensional, laterally elongate supporting substrate comprising:

opposing semicircular regions separated from one another by a distance less than or equal to a radius of each of the opposing semicircular regions;

a rectangular region intervening between the opposing semicircular regions; and a cutting table of a polycrystalline hard material attached to the supporting substrate and comprising a non-planar cutting face.

2. The cutting element of claim 1, wherein each of the opposing semicircular regions and the rectangular region are laterally centered about a central longitudinal plane of the three-dimensional, laterally elongate supporting substrate.

3. The cutting element of claim 1, wherein the three-dimensional, laterally elongate supporting substrate exhibits substantially consistent lateral cross-sectional dimensions throughout a longitudinal thickness thereof.

4. The cutting element of claim 1, wherein the cutting table exhibits a non-axis-symmetrical shape.

5. The cutting element of claim 1, wherein the cutting table exhibits a chisel shape, a frustoconical shape, a conical shape, a dome shape, an elliptical cylinder shape, a rectangular cylinder shape, a pyramidal shape, a frusto pyramidal shape, a truncated version of one of the foregoing shapes, or a combination of two or more of the foregoing shapes.

6. The cutting element of claim 1, wherein a profile of the non-planar cutting face of the cutting table extending in a first direction is different than a profile of the cutting table extending in a second direction perpendicular to the first direction.

7. An earth-boring tool, comprising:

a blade having a pocket therein facing outwardly from a surface of the blade, the pocket completely offset from a leading edge of the blade and exhibiting a three-dimensional, laterally elongate shape; and a cutting element secured within the pocket in the blade and comprising:

a supporting substrate completely laterally surrounded by sidewalls of the supporting substrate and exhibiting a three-dimensional, laterally elongate shape complementary to that of the pocket in the blade, a lateral cross-sectional shape of the supporting substrate comprising:

opposing semicircular regions separated from one another by a distance less than or equal to a radius of each of the opposing semicircular regions;

a rectangular region intervening between the opposing semicircular regions; and a cutting table attached to the supporting substrate at an interface and comprising a non-planar cutting face.

8. The earth-boring tool of claim 7, wherein the supporting substrate of the cutting element is at least partially disposed within the pocket in the blade, and wherein a central longitudinal plane of the pocket is substantially aligned with a central longitudinal plane of the supporting substrate.

9. The earth-boring tool of claim 7, wherein the pocket in the blade laterally surrounds opposing end regions of the supporting substrate of the cutting element with a gap of 0.007 inch or less between the pocket and the opposing end regions of the supporting substrate.

10. The earth-boring tool of claim 7, wherein the pocket in the blade and the supporting substrate of the cutting element share a common center, and wherein a magnitude of an angle between a central longitudinal plane of the pocket and a central longitudinal plane of the supporting substrate is less than or equal to about 3 degrees.

11. The earth-boring tool of claim 7, wherein a shape of the cutting table adjacent one side of a central longitudinal plane of the cutting element is different than another shape of the cutting table adjacent another, opposing side of the central longitudinal plane of the cutting element.

12. The earth-boring tool of claim 7, further comprising an additional cutting element secured to the blade in a rotationally leading position relative to the cutting element.

13. The earth-boring tool of claim 12, wherein a center of a cutting face of the additional cutting element is substantially aligned with a center of the non-planar cutting face of the cutting element.

14. The earth-boring tool of claim 12, wherein the additional cutting element comprises a cutting table exhibiting a substantially planar cutting face.

15. The earth-boring tool of claim 7, wherein the supporting substrate has at least one vent flat in a sidewall thereof.

16. The earth-boring tool of claim 7, wherein:

a central longitudinal axis of the cutting element is oriented perpendicular to the surface of the blade; and the pocket in the blade extends around an entire lateral periphery of the supporting substrate of the cutting element.

17. A method of forming an earth-boring tool, comprising:

forming a pocket exhibiting a non-circular lateral cross-sectional shape in an outwardly facing surface of a blade, the pocket completely offset from a leading edge of the blade; and securing a cutting element within the pocket in the outwardly facing surface of the blade, the cutting element comprising a supporting substrate and a cutting table secured to the supporting substrate, the supporting substrate completely laterally surrounded by the pocket and having a non-circular lateral cross-sectional shape complementary to the non-circular lateral cross-sectional shape of the pocket.

18. The method claim 17, further comprising selecting the cutting table of the cutting element comprising a cutting face to exhibit a non-planar, asymmetric shape.

* * * * *